US007543911B2

(12) United States Patent
Mizes et al.

(10) Patent No.: US 7,543,911 B2
(45) Date of Patent: Jun. 9, 2009

(54) SYSTEMS AND METHODS FOR REDUCING CROSS PROCESS DIRECTION REGISTRATION ERRORS OF A PRINTHEAD USING A LINEAR ARRAY SENSOR

(75) Inventors: Howard A. Mizes, Pittsford, NY (US); Peter Paul, Webster, NY (US); Stanley J. Wallace, Victor, NY (US); Michael D. Borton, Ontario, NY (US); Kenneth R. Ossman, Macedon, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 11/976,992

(22) Filed: Oct. 30, 2007

(65) Prior Publication Data

US 2008/0062219 A1 Mar. 13, 2008

Related U.S. Application Data

(62) Division of application No. 10/998,544, filed on Nov. 30, 2004, now Pat. No. 7,309,118.

(51) Int. Cl.
*B41J 2/15* (2006.01)
*B41J 29/393* (2006.01)

(52) U.S. Cl. ..... 347/41; 347/19

(58) Field of Classification Search ..... 347/19, 347/41

See application file for complete search history.

(56) References Cited

U.S. PATENT DOCUMENTS

| | | | | |
|---|---|---|---|---|
| 5,889,534 | A | 3/1999 | Johnson et al. | |
| 6,213,580 | B1 | 4/2001 | Segerstrom et al. | |
| 6,390,588 | B1 | 5/2002 | Ikeda | |
| 6,409,301 | B1 * | 6/2002 | Takata et al. | 347/19 |
| 6,450,607 | B1 | 9/2002 | Bolash et al. | |
| 2003/0174184 | A1 | 9/2003 | Bildstein et al. | |
| 2003/0218648 | A1 | 11/2003 | Barnes et al. | |
| 2005/0052494 | A1 * | 3/2005 | Takahashi et al. | 347/41 |

FOREIGN PATENT DOCUMENTS

| | | |
|---|---|---|
| EP | 0 934 831 A1 | 8/1999 |
| EP | 1 195 247 A1 | 4/2005 |

* cited by examiner

*Primary Examiner*—Julian D Huffman
*Assistant Examiner*—Jason S Uhlenhake
(74) *Attorney, Agent, or Firm*—Oliff & Berridge, PLC

(57) ABSTRACT

Systems and methods are provided for determining registration errors in the cross process direction of a printer. A first straight line is obtained by detecting line centers of a first plurality of dashes in a test pattern. A second straight line is obtained by detecting a line center positions of a second plurality of dashes in the test pattern. A difference between the off-set of the first straight line and the off-set of the second straight line is used in determining registration errors.

21 Claims, 9 Drawing Sheets

SYSTEMS AND METHODS FOR REDUCING CROSS PROCESS DIRECTION REGISTRATION ERRORS OF A PRINTHEAD USING A LINEAR ARRAY SENSOR

This is a Division of application Ser. No. 10/998,544 filed Nov. 30, 2004. The entire disclosure of the prior application is hereby incorporated by reference herein in its entirety.

BACKGROUND OF THE INVENTION

1. Field of Invention

This invention relates to systems and methods for reducing cross process direction registration errors of a printhead using a linear array sensor.

2. Description of Related Art

Fast printing with a direct marking engine requires the use of multiple printheads. For example, four aligned printheads may be used in a printer to write to a drum rotating underneath them. Each printhead has six degrees of positional freedom, three translational and three rotational. The printheads need be precisely aligned so that there is a smooth transition from one printhead to the other in the printed image.

In order to achieve a high resolution, it may also be necessary for the drum of the printer to make multiple passes while the printheads are translated in the cross process direction after each rotation along the axis of the drum. In this case, the transition of the printhead needs to be precise, to achieve equal spacing between the centers of the printed lines during the passes.

SUMMARY OF THE INVENTION

For a printer having multiple printheads, when the printheads are not precisely aligned, a print defect can occur at the boundary between two printheads. An example of such print defect is x-stitch, defined as a displacement of the printhead in the cross process direction from its optimal spacing. Stitch can open or close a gap between the printheads and lead to a streak in the printed images. Even for small values of stitch, a noticeable streak may be observed at the interface between two printheads.

Also, when the drum makes multiple passes while the printheads are translated in the cross process direction after each rotation along the axis of the drum, if the translation of the printheads is not precise, the centers upon which image pixels are written will not be equally spaced, leading to a high frequency periodic streaking in the image.

Various exemplary embodiments according to this invention provide systems and methods for aligning and controlling printheads and for reducing cross process direction registration errors of a printhead using a linear array sensor. Test patterns are used in such exemplary embodiments of systems and methods.

In one exemplary embodiment, a method for detecting an x-stitch error between two printheads includes printing a test pattern in a single pass consisting of process direction dashes printed using a plurality of nozzles on each side of the interface, obtaining the positions of the process direction dashes in the cross process direction by processing an image collected with a linear array, and calculating an appropriate linear combination of the dash positions that best eliminates the misdirection error in the dash x-position and results in the x-stitch.

In another exemplary embodiment, a method for detecting an x-interlace error includes of printing a test pattern that consists of a plurality of process direction dashes written during different passes of the print head and obtaining the positions of the process direction dashes in the cross process direction. For one test pattern consisting of a series of strips where each strip is written using the same nozzles in a different pass, the x-interlace is given by the mean of the differences between the cross process positions of dashes written with the same nozzle. For another test pattern consisting of a single strip with nominally equally spaced dashes written during different passes, an measurement of nonequal spacing signifies a failure in the calibration of the x-interlace step size.

This and other features and advantages of this invention are described in, or apparent from the following detailed description of various exemplary embodiments of the systems and methods according to this invention.

BRIEF DESCRIPTION OF THE DRAWINGS

Various exemplary embodiments of the systems and methods of this invention will be described in detail, with reference to the following figures, wherein:

FIG. 1 illustrates an exemplary embodiment of a printed test pattern that contains stitching errors according to the present invention;

DETAILED DESCRIPTION OF EXEMPLARY EMBODIMENTS

Figure 7:
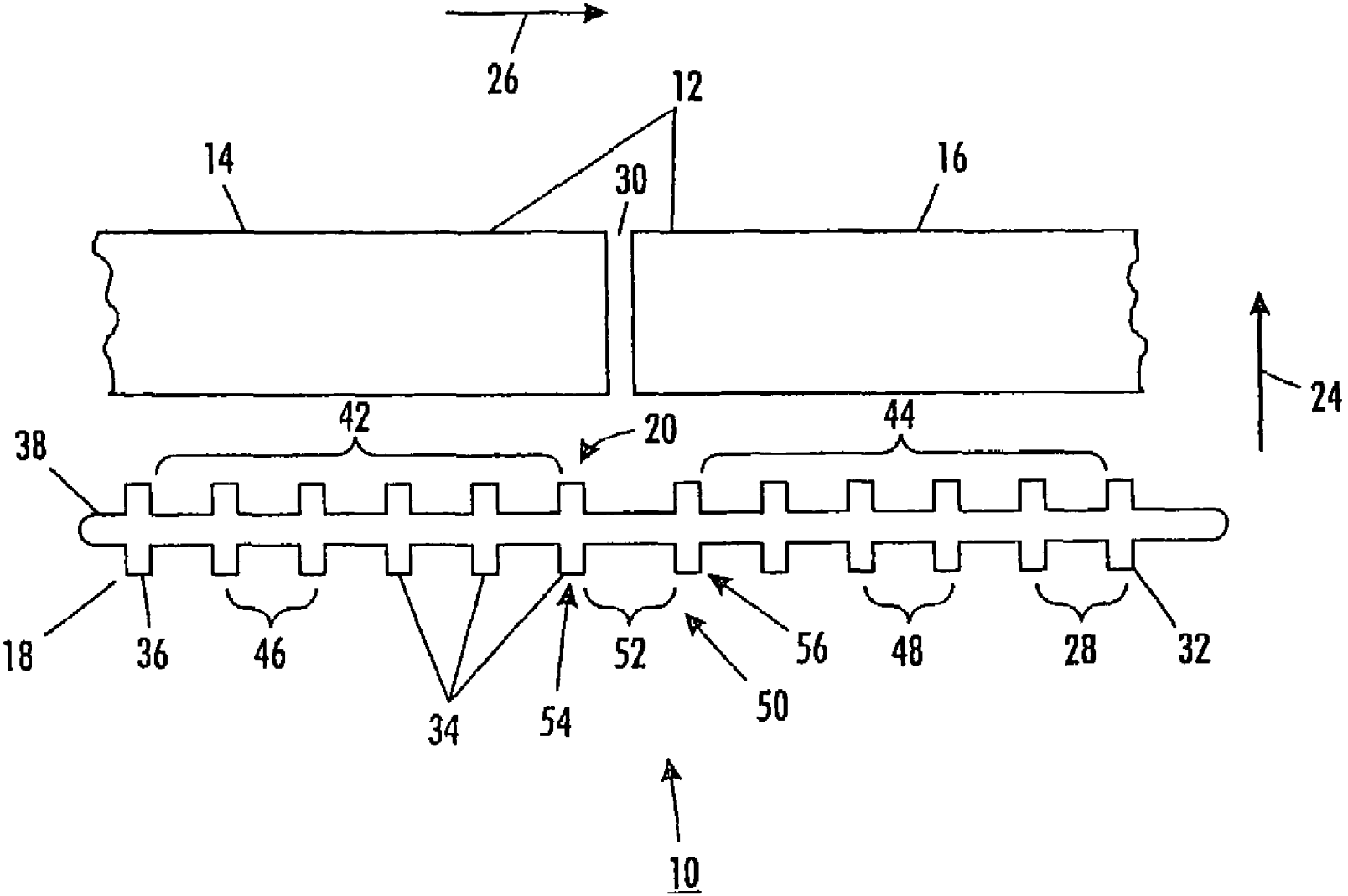
FIG. 7 is a flowchart outlining one exemplary embodiment of a method for reducing cross process direction registration errors according to the present invention.

FIG. 1 illustrates an exemplary embodiment according to this invention. As shown in FIG. 1, a system 10 includes a plurality of printheads 12, such as 14 (printhead 1) and 16 (printhead 2). Each printhead 12 is equipped with a plurality of nozzles (not shown).

Each printhead 12 has a plurality of degrees of positional freedom. In various exemplary embodiments of the present invention, each print head 12 has six degrees of positional freedom, including three translational and three rotational degrees of freedom.

As shown in FIG. 1, a test pattern 18 printed by the nozzles of the printheads 12 includes a row of dashes 20, with each dash 22 running in the process direction 24 (vertical direction, or y-axis direction). The dashes 20 are spaced apart in the cross process direction 26 (horizontal direction, or x-axis direction). In various exemplary embodiments, the dashes 20 are of substantially the same length. In other various exemplary embodiments, the dashes 20 are repeated in the process direction.

In various exemplary embodiments, the dashes 20 are spaced in the horizontal direction 26 (x-axis direction) far enough apart so that they can be distinguished by a linear array sensor. The dashes 20 are long enough in the vertical direction 24 (y-axis direction) so that they can be distinguished over the substrate noise.

In various exemplary embodiments, the test pattern 18 is used to detect x-axis stitch (or x-stitch), which is a translation of the printhead 12 in the cross process direction 26. In such exemplary embodiments, the dashes 20 are produced in a single pass by the nozzles of the printheads 12. When the printheads 12 are precisely aligned, there is a smooth transition from one printhead 12 to the other in the image. Thus, the dashes 20 produced by the nozzles of different printheads are spaced with an equal distance 28 in the cross process direction 26, as shown in FIG. 1.

In various exemplary embodiments, the test pattern 18 is used to detect x-axis stitch (or x-stitch), which is a translation of the printhead 12 in the cross process direction 26. In such exemplary embodiments, the dashes 20 are produced in a single pass by the nozzles of the printheads 12. When the printheads 12 are precisely aligned, there is a smooth transition from one printhead 12 to the other in the image. Thus, the dashes 20 produced by the nozzles of different printheads are spaced with an equal distance 28 in the cross process direction 26. However, when the printheads 12 are not precisely aligned, a print defect can occur at the boundary 30 between two printheads 12.

The linear array sensor detects along a line of response 38. The line of response 38 extends in the x-axis direction 26, as shown in FIG. 1.

As shown in FIG. 1, the ink and drum image 34 includes a plurality of groups of printed dashes 20, such as 42 (group 1) and 44 (group 2). Each printed group of dashes 20 is produced by a plurality of nozzles of a corresponding printhead 12. For example, group 1 of printed dashes 42 is produced by the nozzles of 14 (printhead 1). Group 2 of dashes 44 is produced by the nozzles of 16 (printhead 2).

As shown in FIG. 1, the printed dashes 42 in group 1 are spaced substantially equally with a distance 46 in the cross process direction 26. Similarly, the printed dashes 44 in group 2 are also spaced substantially equally with a distance 48 in the cross process direction 26. In addition, the distance 46 is substantially the same as the distance 48.

However, when 14 (printhead 1) and 16 (printhead 2) are not precisely aligned, a stitch error 50 occurs in the printed dashes. In particular, as shown in FIG. 1, the distance 52 between the last printed dash 54 of group 1 (the dash at the right hand side end of group 1) and the first printed dash 56 of group 2 (the dash at the left hand side end of group 2) is different from the distance 46 among the printed dashes of group 1.

Imperfections in the printing process may cause the intended position of the drop to differ from the actual position. Specifically, if the drop does not eject normal to the orifice, the actual position will vary. This error is uncorrelated for each nozzle. If only the spacing 52 of the dashes at the interface is measured, a measurement of the x-stitch may be inaccurate because of the drop position error. However, if x-stitch is inferred from the measurement of the position of jets written by multiple nozzles, then the position errors tend to cancel out and the measurement of x-stitch is more accurate.

The presence of dashes changes sensor response. In particular, the presence of ink on the drum can either decrease or increase the response of sensors, depending on the relative colors of the ink and the drum and the texture of the ink and the drum. For the ease of discussion, it is assumed that the presence of ink decreases sensor response. However, it should be appreciated that the discussion below also applies when the presence of ink increases sensor response.

In various exemplary embodiments, a cross section of sensor response is used to detect errors in a printed image. The cross section of the sensor response is a collection of profiles through the dashes in the test pattern. A profile includes sensor response along the cross process direction at a particular process direction location. In various exemplary embodiments, the cross section is a collection of profiles through all the dashes in a test pattern. In various other exemplary embodiments, the cross section is a collection of profiles through the dashes near the interface between two printhead.

In a response profile of a cross section of sensor response, sensor response maxima occur at locations corresponding to positions where dashes do not exist, such as the gaps between dashes. On the other hand, sensor response minima occur in the response profile at positions corresponding to locations where dashes are printed. The positions of the minima are used to obtain the locations of the corresponding dashes. In various exemplary embodiments, the positions of the minima are also used to obtain information of the nozzles which produced the dashes.

In various exemplary embodiments, the centers of the dashes may be determined based on the cross section of sensor response, using the minima in the response profile. The determination may be achieved by any existing or later developed techniques. In various exemplary embodiments, the center of a dash line is determined based on an interpretation of the response data near the dash line, a mid-point of the line edges of a detected dash line, a non-linear least squares fit, or a multi-dimension vector under the Radar theory.

Once the x-positions of a plurality of dashes are obtained, an appropriate linear combination of them will result in an estimation of the true x-stitch between the two printheads.

In various exemplary embodiments, the measured position of a dash is extracted from the linear array signal. The expected position of the dash corresponds to the physical position of the nozzle that ejects the drop for perfect head alignment and perfect drop ejection geometry.

Figure 2:
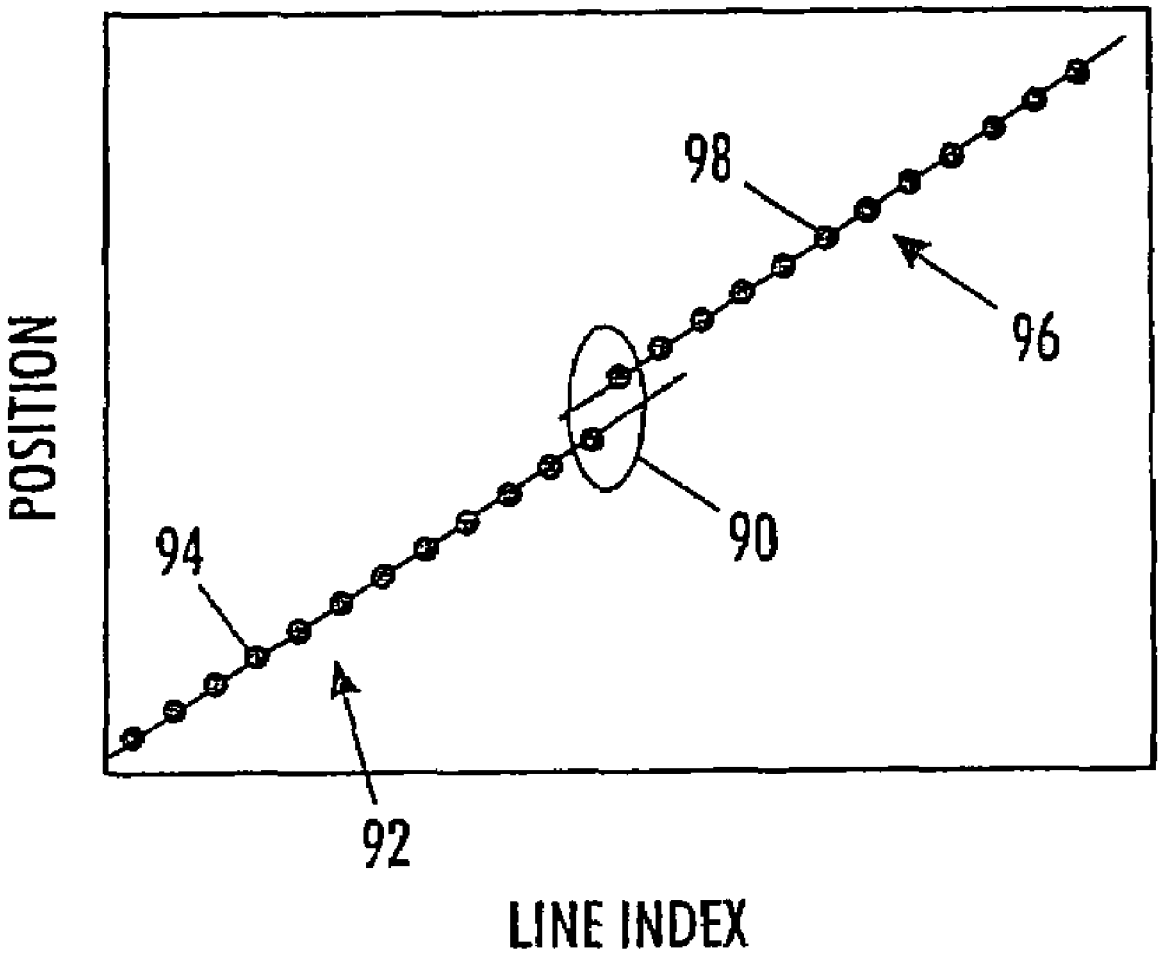
FIG. 2 illustrates the separate curve fit to measured dash position vs. expected dash position for dashes adjacent to the printhead interface.

FIG. 2 illustrates one exemplary embodiment of a technique that mitigates drop position errors. FIG. 2 plots the expected position of the test pattern dash on the x axis and the measured position of the test pattern dash on the y axis. As shown in FIG. 2, a first straight line 92 is a least squares fit to the measured test pattern dash position vs. the expected test pattern dash position for dashes written with the left head (printhead 14 in FIG. 1). A second straight line 96, located at the right hand side in FIG. 2, represents a least squares fit to the measured test pattern dash positions vs. the expected test pattern dash positions for dashes written with the right head (printhead 16 in FIG. 1).

In various exemplary embodiments, the difference 90 between the off-sets of the two straight lines 92 and 96 in FIG. 2 is used to detect x-axis stitch between two printheads. In such exemplary embodiments, the first plurality of dashes 94 are produced by the nozzles of the first printhead 14, and the second plurality of dashes 98 are produced by the nozzles of the second printhead 16 (see FIGS. 1 and 2). When the two printheads 14, 16 are precisely aligned, the spacing or distance 52 between the last dash 54 in the first plurality of dashes 42, 94 and the first dash 56 in the second plurality of dashes 44, 98 is the same as the spacing or distance 46, 48 among the dashes of the first plurality of dashes 42, 94, or among the dashes of the second plurality of dashes 44, 98 (see FIG. 1). Thus, the two straight lines 92, 96 in FIG. 2 will have the same off-set, and therefore will match to become one straight line (not shown).

However, when the two printheads 14, 16 are not precisely aligned, the spacing or distance 52 between the last dash 54 of the first plurality of dashes 42, 94 and the first dash 56 in the second plurality of dashes 44, 98 will be different from the spacing or distance 46, 48 among the first plurality of dashes 42, 94 or among the second plurality of dashes 44, 98. Thus, the two straight lines 92, 96 in FIG. 2 will have different off-sets. In particular, as shown in FIG. 2, there will be a mismatch 90 between the two straight lines. Such a displacement between the two straight lines indicates the x-axis stitch error.

In various exemplary embodiments, each straight line 92, 96 in FIG. 2 is obtained by a least squares fit. A line is described by a slope and an offset. If the position of the interface is defined as zero, then the offset between the lines obtained by the least squares fit is the difference between the offsets. If N dashes are measured on the left side of the interface, and N dashes are measured on the right side of the interface, and the expected spacing between the dashes are all equal, then the difference between the offsets can be solved analytically and that expression is $$\Delta x = \sum_{i=1}^{N} \frac{3N(2i-1)+(1-4N^2)}{N(1-N^2)}(M_{Li}+M_{Ri}) \tag{1}$$

where $M_{Li}$ is the measured position of the $i^{th}$ dash from the interface on the left side, $M_{Ri}$ is the measured position of the $i^{th}$ dash from the interface on the right side, and $\Delta x$ is the difference in the offset between the two printheads.

Equation (1) is a particular linear combination of the measured positions of the dashes. In this particular linear combination, the dashes further from the interface have a larger contribution to the sum than the dashes closer to the interface. However, the position of the dashes closer to the interface have a more significant contribution to the appearance of the image defect if there is a stitch error. A mathematical technique to increase the significance of these dashes is to perform a least squares fit by weighting the contribution of each dash according to its distance from the interface. This weighting will result in an expression similar to Equation (1). It will also be a linear combination of the dash positions, but with a different set of coefficients depending on the weights given to each dash.

Figure 3:
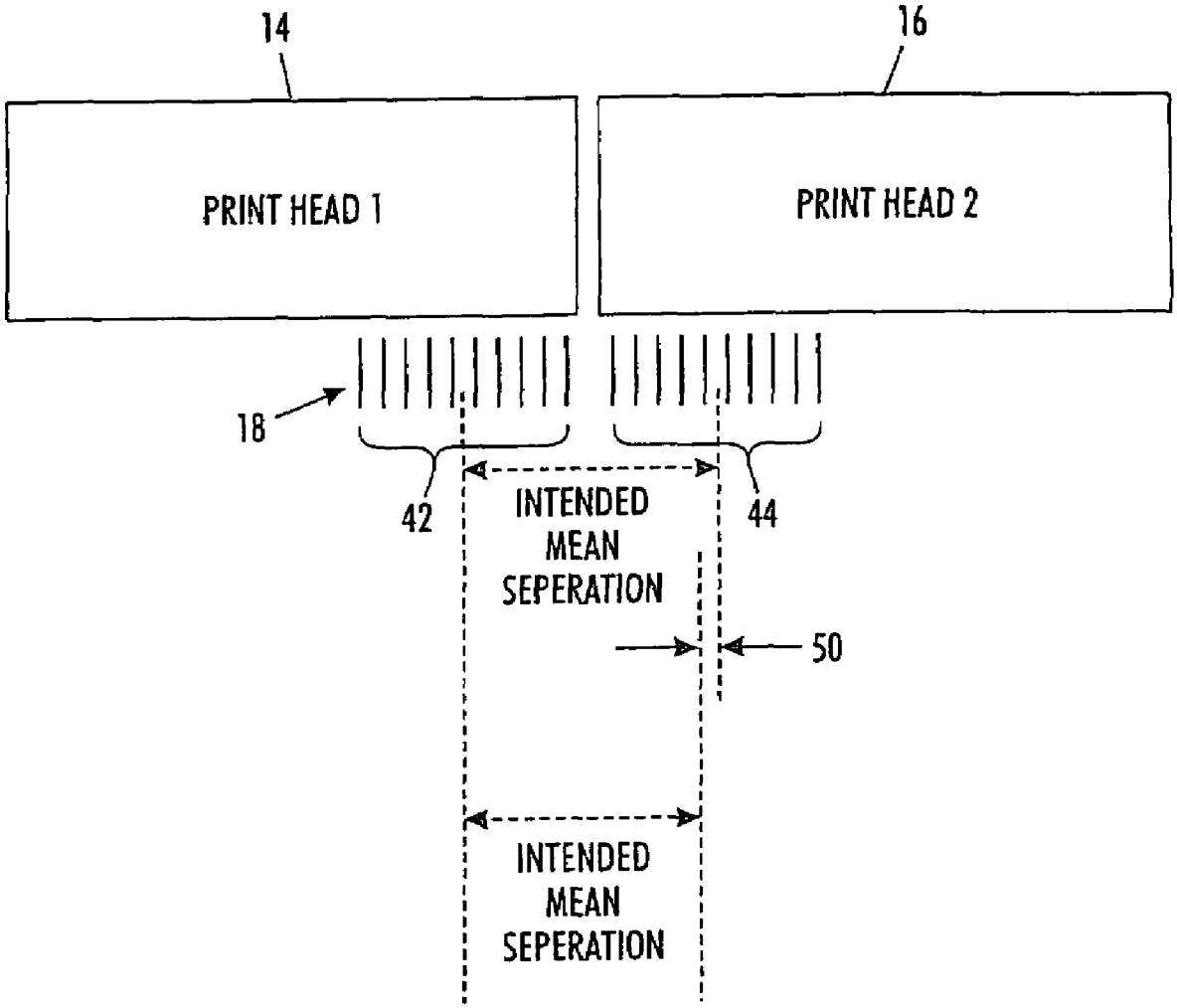
FIG. 3 illustrates an exemplary embodiment of using the mean position of the dashes on each side of the interface to extract the x-stitch according to the present invention.

In various other exemplary embodiments, the x-stitch is estimated by calculating the mean difference between the set of dashes 42 on the left side of the interface and the set of dashes 44 on the right side of the interface. As shown in FIG. 3. The stitch 50 is given by $$\Delta x = \frac{1}{N}\sum_{i=1}^{N} M_{Ri} - \frac{1}{n}\sum_{i=1}^{N} M_{Li} - Ns \tag{2}$$

where $M_{Li}$ is the measured position of the $i^{th}$ dash from the interface on the left side, $M_{Ri}$ is the measured position of the $i^{th}$ dash from the interface on the right side, N is the number of dashes printed on both sides of the interface, s is the expected spacing between adjacent test pattern dashes, and $\Delta x$ is the difference in the offset between the two printheads.

Figure 4:
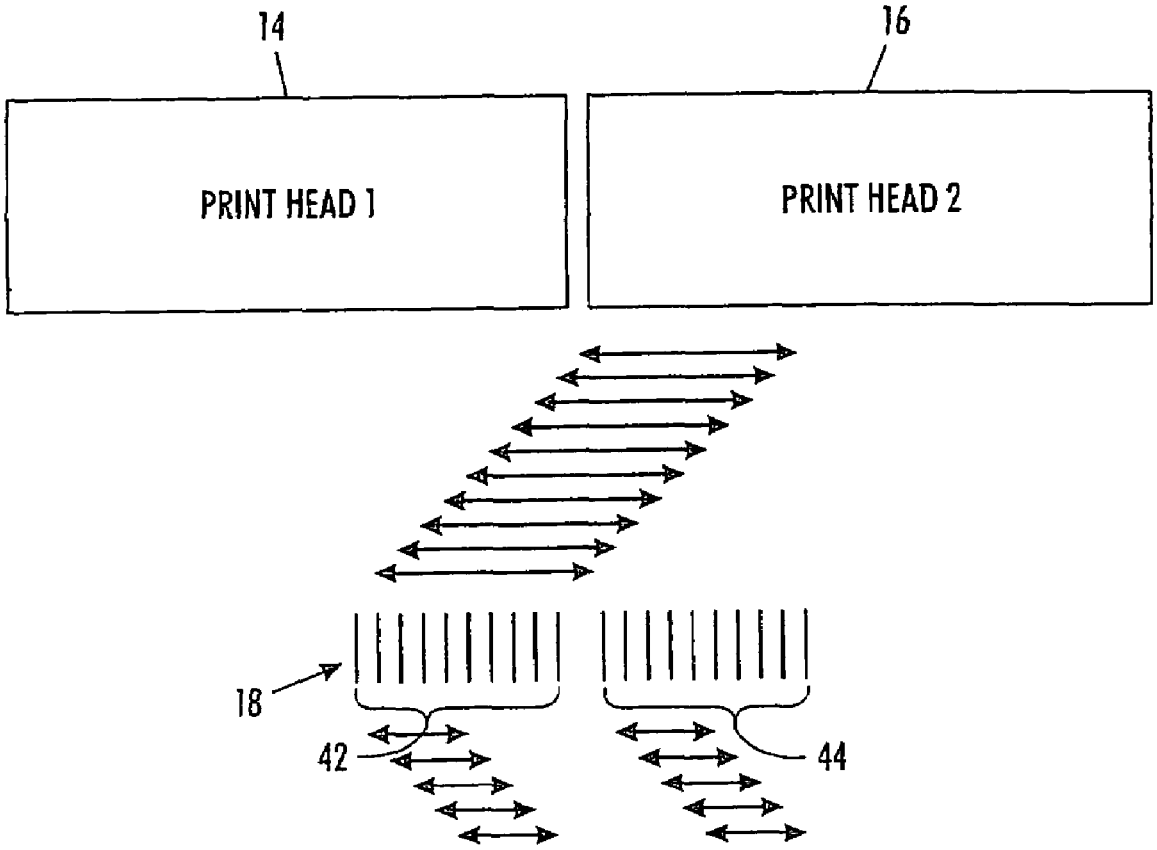
FIG. 4 illustrates an exemplary embodiment of using separation of jets on opposite sides of the interface to extract the x-stitch according to the present invention.

For some linear array sensors, the magnification of the sensor may be unknown. It is possible to use the measured spacing between dashes to self-calibrate the measurement. The expected distance between adjacent dashes may be calculated from the measured position of pairs of dashes on the same side of a print head interface. One particular embodiment of calculating the dash spacing is illustrated in FIG. 4. The arrows below the test pattern indicate one particular way to measure the average spacing between dashes. The length of each arrow corresponds to the dash spacing, and the tip of each arrow is below the dash being measured. The mean of the arrow lengths divided by N/2 gives the nominal dash spacing.

The stitch error changes the spacing between dashes measured on opposite sides of the interface. There may be a number of combinations of dashes that may be used to estimate these quantities. In one exemplary embodiment, each dash contributes once to the sum. When there are N printed dashes on the left side of the interface and N printed dashes on the right side of the interface, the determination of the expected dash spacing is made based on the arrows above the test pattern shown in FIG. 4. The mean of all the arrow lengths above the test pattern should equal N times the expected dash spacing. The presence of a gap between the print heads will increase the spacing between dashes on opposite sides of the interface. The difference between the expected spacing between dashes across the print head and the measured spacing gives the x-stitch. In the exemplary embodiment shown in FIG. 4, estimate of this quantity is obtained by averaging the spacing between all dash pairs indicated by the upper arrows in FIG. 4 The x-stitch is then given by $$\Delta x = S_{gap} - S_{nom} = \frac{1}{N}\sum_{i=1}^{N}(M_{R,i} - M_{L,N-i+1}) - \frac{1}{N/2}\sum_{i=1}^{N/2} M_{R,i+N/2} - M_{R,i} + M_{L,i} - M_{L,i+N/2} \tag{3}$$

where $\Delta x$ is the spacing between the printheads, $S_{gap}$ is the average increase in the measured spacing for dash displacement measurements across the interface, $S_{nom}$ is the average spacing between dash displacement measurements within one printhead, $M_{Li}$ is the measured position of the $i^{th}$ dash from the interface on the left side, $M_{Ri}$ is the measured position of the $i^{th}$ dash from the interface on the right side, and N is the number of dashes printed on both sides of the interface.

In various exemplary embodiments, the x-axis stitch is determined based on an average of results from multiple measurements. Such average may smooth out noises, such as errors introduced by misdirectionality of nozzles.

FIG. 7 is a flowchart outlining one exemplary embodiment for detecting an error according to this invention. Starting from step S1100, the method proceeds to step S110, where the test pattern is imaged with the linear array sensor and the image of the dash test pattern is collected. Then in step S120, the line centers of all the dashes in the test pattern are obtained by image analysis, and dash positions are obtained.

Then in step S130, an appropriate linear combination of the dash x-positions are calculated to obtain the x-stitch error. The weights of the linear combination are derived from the algorithm to estimate x-stitch most accurately in the presence of drop misdirectionaility, within a predetermined accuracy.

In step S140, a determination is made whether to adjust a printhead or printheads. If it is determined in step S140 to adjust a printhead or printheads, operation continues to step S150. If not, operation proceeds to step S170.

In step S150, the printhead or printheads is adjusted to reduce, correct, eliminate or minimize errors. Then, operation continues to step S160.

In step S160, a determination is made whether to detect errors again. If it is determined in step S160 to detect errors again, operation jumps back to step S110, where the detection process gets repeated. If not, operation proceeds to step S170, where operation of the method ends.

The drum of a printing device may make multiple passes to achieve high resolution. The drum makes multiple passes while the printheads are translated after each rotation along the axis of the drum. When the translation of the printhead is not precise, the spacing or distance between the centers upon which the image pixels are written will not be equally spaced, leading to a high frequency periodic streaking in the image.

Figure 5:
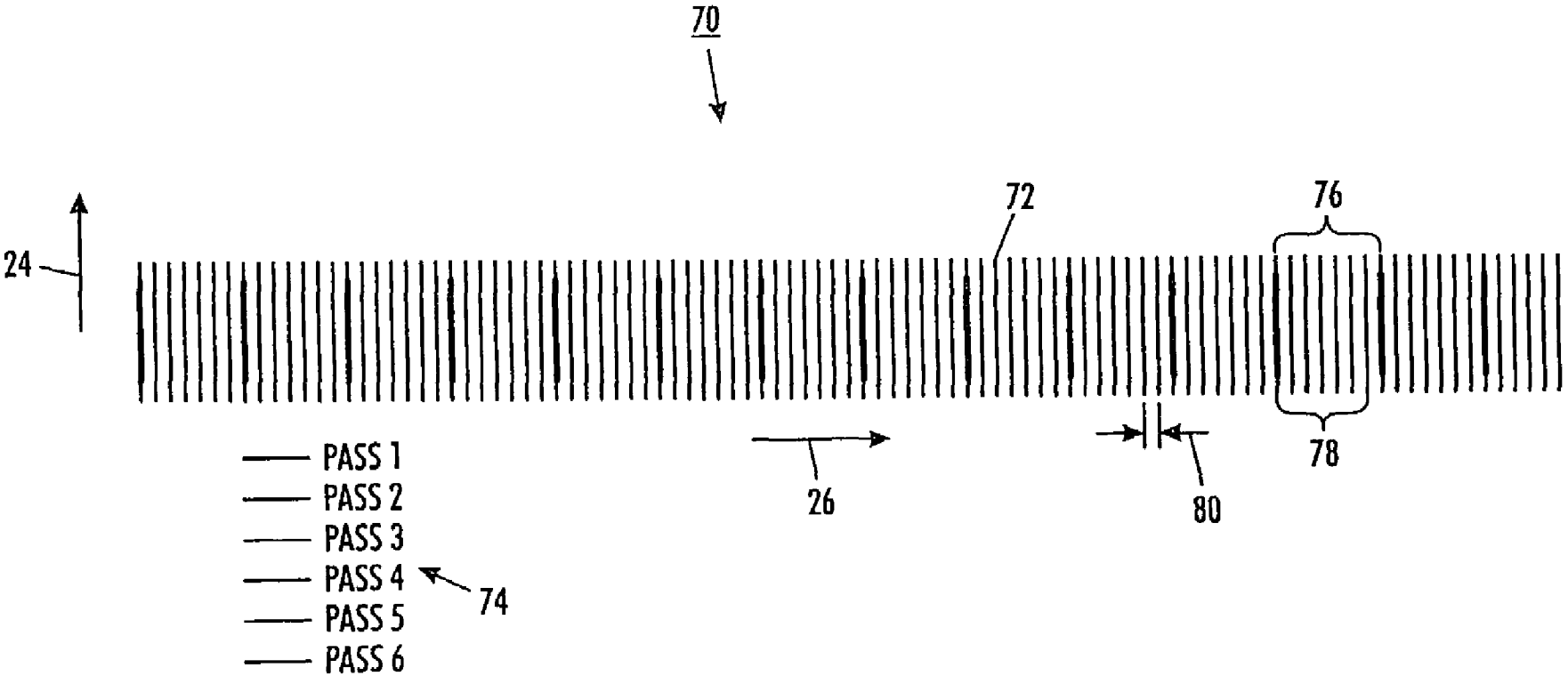
FIG. 5 illustrates an exemplary embodiment of a single row printed test pattern that contains x-interlace errors according to the present invention.

In various exemplary embodiments, a test pattern is used to detect whether the printhead is precisely translated when the drum makes multiple passes. As shown in FIG. 5, the test pattern 70 includes a plurality of dashes, each dash running in the process direction 24. The dashes 72 are written using N passes, where N is the number of passes required to make a complete image. In various exemplary embodiments, the dashes 72 are far enough apart in the cross process direction 26 so that the centers can be individually distinguished by a sensor. The dashes 72 are long enough in the process direction 24 so that they can be distinguished over the substrate noise.

In the exemplary embodiment shown in FIG. 5, the test pattern 70 contains dashes 72 from six passes 74, with a interlace pattern of a pass-to-pass translation scheme 1-6-3-5-2-4-1-6-3-5-2-4. Accordingly, the pass 1 to pass 6 spacing or distance 76 is 7/6 times the corresponding nozzle spacing or distance 78. It should be appreciated that other numbers of passes and other pass-to-pass translation schemes may also be used.

When the translation of the printhead is precise, the spacing 80 between the dashes 72 of different passes are substantially the same. However, when the translation of the printhead is not precise, the spacing 80 will not be the same, leading to an x-axis interlace error.

Figure 6:
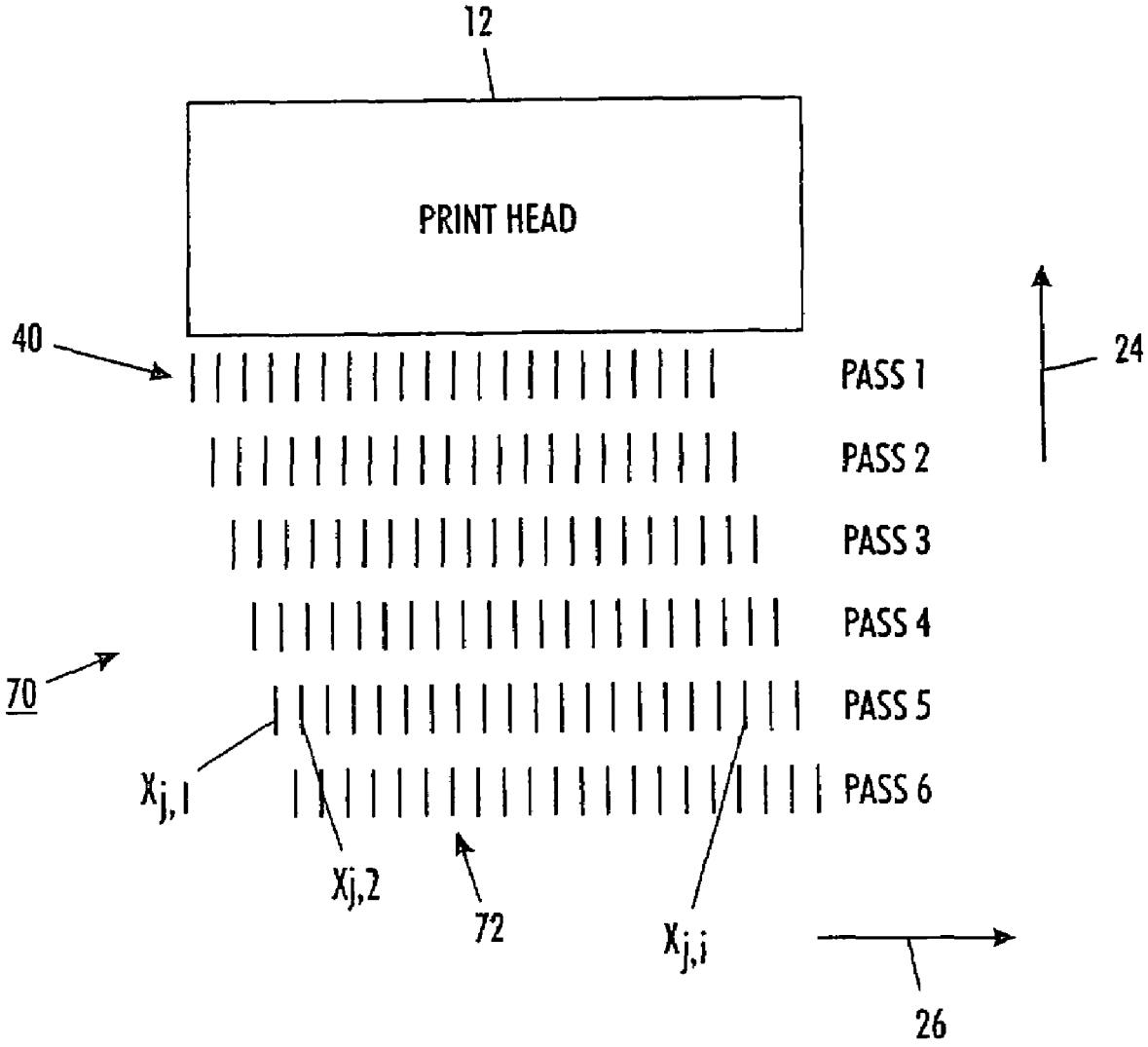
FIG. 6 illustrates an exemplary embodiment of a multiple row printed test pattern that contains x-interlace errors according to the present invention.
Figure 7:
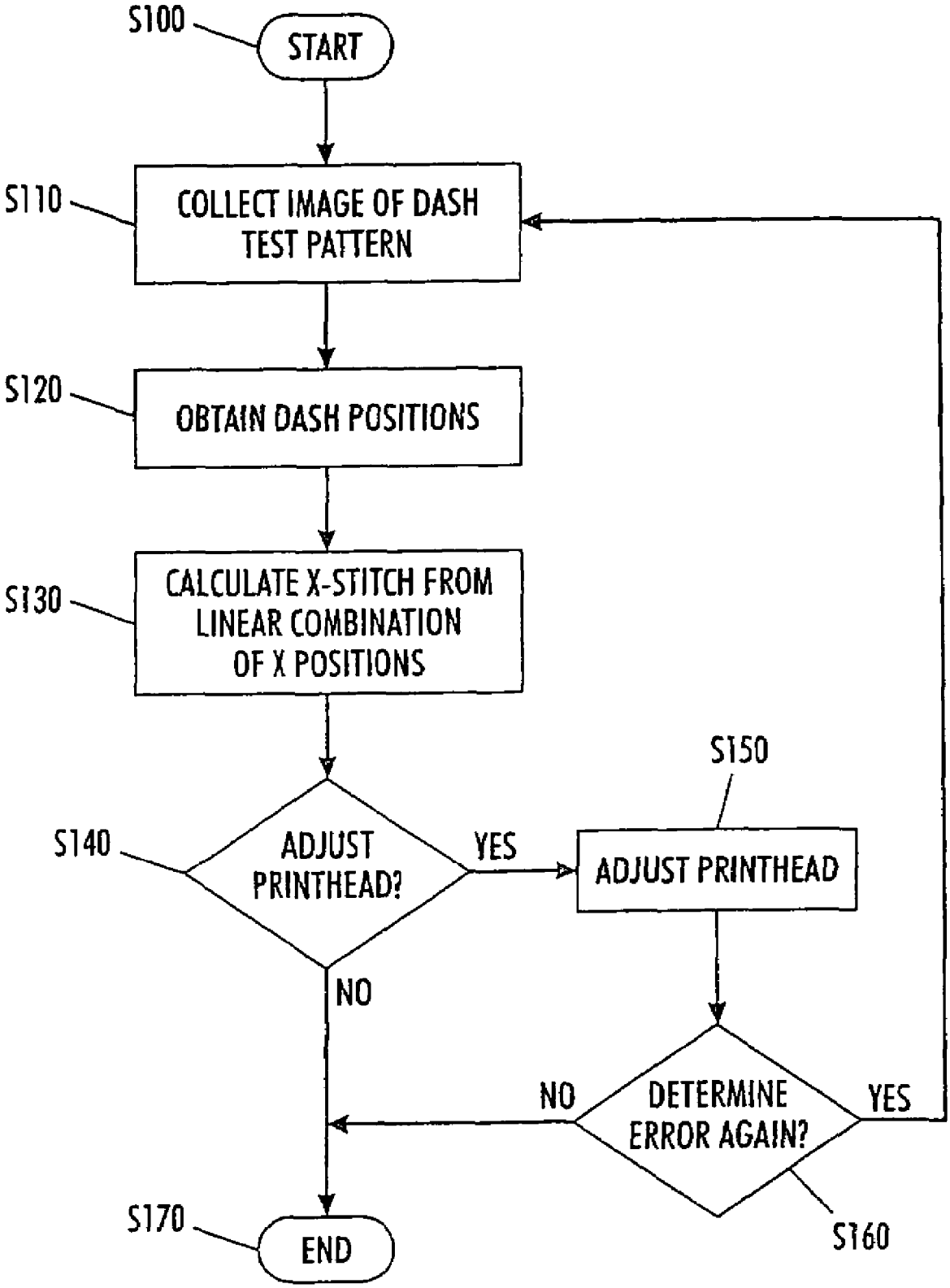

The presence of a random drop misdirectionality may make the determination of an interlace error less precise. In another embodiment of a test pattern according to the present invention, the same nozzles are used to write the test pattern during each pass, as shown in FIG. 6. Because the drop misdirectionaility is the same for the dashes being compared, it does not introduce an error in the determination of the interlace.

As shown in FIG. 6, the test pattern 70 includes a plurality of strips 40. Each strip 40 contains a plurality of dashes 72, each dash 72 running in the process direction 24. The number of strips is equal to the number of passes used in printing a full image. Each pass is printed using the same nozzles. In various exemplary embodiments, the dashes 72 are far enough apart in the cross process direction 26 so that the centers can be individually distinguished by a sensor. The dashes 72 are long enough in the process direction 24 so that they can be distinguished over the substrate noise.

When the translation of the printhead is precise, the average spacing between the dashes 72 in the different strips 40 will be as intended. When the translation of the printhead is not precise, the spacing will be measured different as intended, leading to an x-axis interlace error.

The interlace is calculated by determining a linear combination of the measured dash positions.

For the test pattern as shown in FIG. 5, when the motion from pass to pass is as intended and drop misdirectionality is absent, then the dashes would be equally spaced. When the motion from pass to pass is not as intended, but there is significant drop misdirectionality, then the motion error may not be significant enough to affect image quality. When the motion from pass to pass is not as intended and exceeds the magnitude of the drop misdirectionality, then streaking from this error would occur. To determine if this latter condition is met, then the average spacing between adjacent pairs of dashes written during the same two passes is calculated. In various exemplary embodiments, when the range of these set of numbers significantly exceeds the distribution tails of the misdirection of the dashes, then the control to the motor is modified so the intended displacement is achieved.

In the exemplary test pattern shown in FIG. 6, $x_{j,i}$ is the position of dash number i counting from the strip printed during pass j. The average spacing between a dash in pass j=j1 and a corresponding dash in pass j=j2 is given by $$\Delta x_{j1,j2} = \frac{1}{N}\sum_{i=1}^{N} x_{i,j2} - x_{i,j1} \tag{4}$$

$$\Delta x_{j=1,j=2} = \frac{1}{N}\sum_{i=1}^{N} x_{j=2,i} - x_{j=1,i}$$

In some exemplary embodiments, different print heads are controlled by different motors. In these embodiments, the dashes corresponding to each print head are summed separately and a motion of each print head is calculated independently.

In some exemplary embodiments, the spatial calibration of the linear array sensor is known. For these embodiments, the measured displacement for each pass is compared to the intended displacement. If the difference is too large, then the control to the motor is modified so the intended displacement is achieved.

In other exemplary embodiments, the spatial calibration of the linear array sensor is not known. For these embodiments, the spacing between the dashes in the test pattern is used to scale the position measurements. In various exemplary embodiments, when the test pattern dashes are spaced 12/450 inch apart, and a step size of 4/450 of an inch is desired, then it is determined if the strips are offset by ⅓ of the spacing between dashes in the strip.

In various exemplary embodiments, the x-axis stitch is determined based on an average of results from multiple measurements. Such average may smooth out noises, such as errors introduced by misdirectionality of nozzles.

Figure 8:
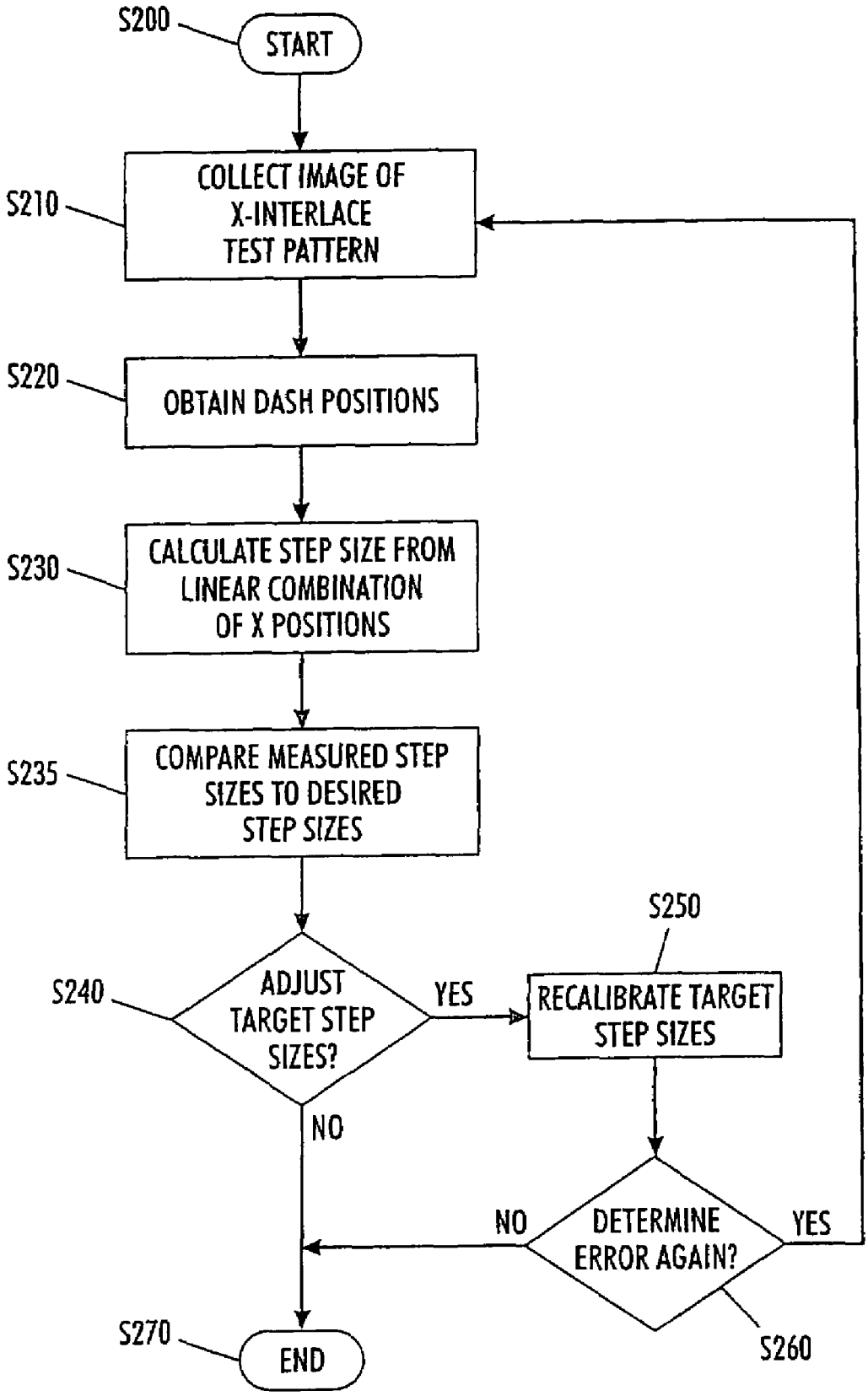
FIG. 8 is a flowchart outlining one exemplary embodiment of a method for reducing x-interlace errors according to the present invention.

FIG. 8 is a flowchart outlining one exemplary embodiment for detecting an error according to this invention. Starting from step S200, the method proceeds to step S210, where the test pattern is imaged with the linear array sensor and the image is collected. Then in step S220, the line centers of all the dashes in the test pattern are obtained by image analysis, and dash positions are obtained.

Next, in step S230, step sizes are calculated from combinations of X positions. If the test pattern is a multiple strip test pattern, then in step S230, the displacements between dashes printed with the same nozzles for different passes are averaged to obtain the motion for each step and for each print head. If the test pattern is a single strip test pattern, then in step 230, a set of displacements between adjacent dashes corresponding to the same pass numbers are calculated. Then in step S235, the measured/calculated step sizes are compared to desired step sizes.

In step S240, a determination is made whether to adjust the target step sizes. If it is determined in step S240 to adjust a the target step size, operation continues to step S250. If not, operation proceeds to step S270.

In step S250, the target step size is adjusted to reduce, correct, eliminate or minimize errors. Then, operation continues to step S260.

In step S260, a determination is made whether to detect the step sizes again. If it is determined in step S260 to detect errors again, operation jumps back to step S210, where the detection process gets repeated. If not, operation proceeds to step S270, where operation of the method ends.

Figure 9:
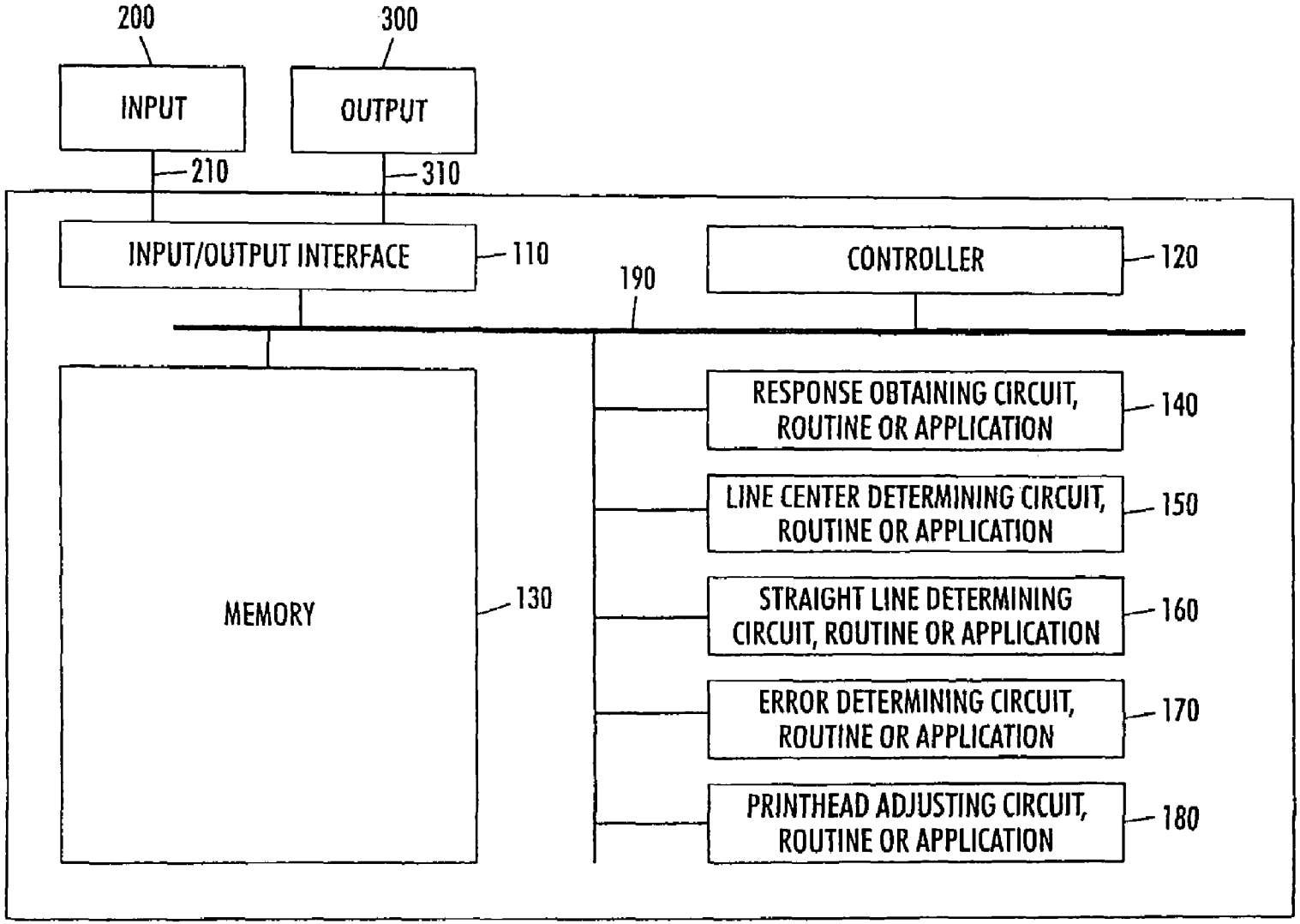
FIG. 9 is a functional block diagram of a exemplary embodiment of a system for reducing cross process direction registration errors according to the present invention.

FIG. 9 is a functional block diagram of an exemplary embodiment of a printhead alignment system according to this invention. As shown in FIG. 9, the printhead alignment system 100 may include an input/output (IO) interface 110, a controller 120, a memory 130, a response obtaining circuit, routine or application 140, a line center determining circuit, routine or application 150, a straight line determining circuit, routine or application 160, an error determining circuit, routine or application 170, and a printhead adjusting circuit, routine or application 180, each interconnected by one or more control and/or data buses and/or application programming interfaces 190.

In various exemplary embodiments, the printhead alignment system 100 is implemented on a programmable general purpose computer. However, the printhead alignment system 100 can also be implemented on a special purpose computer, a programmed microprocessor or microcontroller and peripheral integrated circuit elements, an ASIC or other integrated circuits, a digital signal processor (DSP), a hard wired electronic or logic circuit, such as a discrete element circuit, a programmable logic device such as a PLD, PLA, FPGA or PAL, or the like. In general, any device capable of implementing a finite state machine that is in turn capable of implementing the flowchart show in FIGS. 7 and 8 can be used to implement the printhead alignment system 100.

The input/output interface 110 interacts with the outside of the printhead alignment system 100. In various exemplary embodiments, the input/output interface 110 may receive input from the input 200 via one or more links 210. The input/output interface 110 may output data to the output 300 via one or more links 310.

The memory 130 may also store any data and/or program necessary form implementing the functions of the printhead alignment system 100. The memory 130 can be implemented using any appropriate combination of alterable, volatile, or non-volatile memory or non-alterable or fixed memory. The alterable memory, whether volatile or non-volatile, can be implemented using any one or more of static or dynamic RAM, a floppy disk and a disk drive, a writable or rewritable optical disk and disk drive, a hard drive, flash memory or the like. Similarly, the non-alterable or fixed memory can be implemented using any one or more of ROM, PROM, EPROM, EEPROM, and optical ROM disk, such as a CD-ROM or a DVD-ROM disk and disk drive or the like.

In the exemplary embodiments of the print head alignment system 100, the response obtaining circuit, routine or application 140 obtains a cross section of sensor response. The line center determining circuit, routine or application 150 determines line center positions of a set of dashes based on the cross section of sensor responses. The linear combination of x-centers circuit, routine or application 160 obtains a metric for x-stitch or x-interlace based on the line center positions. The error determining circuit, routine or application 170 determines registration errors based on a difference between the off-sets of two straight lines, or between the offset of one line and a reference. The printhead adjusting circuit, routine or application 180 adjust a printhead or printheads to reduce or correct errors.

In operation of the exemplary embodiments of the printhead alignment system 100 shown in FIG. 9, the response obtaining circuit, routine or application 140, under control of the controller 120, obtains cross section of sensor response from the input 200 via the one or more links 210 and the input/output interface 110. The line center determining circuit, routine or application 150, under control of the controller 120, determines the line center positions of a plurality of dashes of a test pattern based on the cross section of sensor responses. The straight line determining circuit, routine or application 160, under control of the controller 120, determines a straight line based on the line center positions.

The error determining circuit, routine or application 170, under control of the controller 120, determines whether there is a difference between the off-sets of two straight lines, or between the offset of one straight line and a reference. A difference, when determined, indicates a registration error. In various exemplary embodiments, the difference and/or its related data is output at the output 300 via the one or more links 310 and the input/output interface 110. The output difference may be used to adjust or correct printhead alignment.

In various other exemplary embodiments, the difference and/or its related data is used for the printhead adjusting circuit, routine or application 180 to adjust a printhead or printheads to reduce or correct errors. Further, in such exemplary embodiments, the controller 120 may control the various circuits, routines or applications to detect errors again after adjusting the printhead or printheads.

In various exemplary embodiments, the response obtaining circuit, routine or application 140, the line center determining circuit, routine or application 150, the straight line determining circuit, routine or application 160, the error determining circuit, routine or application 170, and the printhead adjusting circuit, routine or application 180 may store their respective processed data in memory 130. They may also access the data to be processed from the memory 130.

The method illustrated in FIGS. 7 and 8 may be implemented in a computer program product that can be executed on a computer. The computer program product may be a computer-readable recording medium on which a control program is recorded, or it may be a transmittable carrier wave in which the control program is embodied as a data signal.

In various exemplary embodiments, systems, such as the system shown FIG. 9, may be included in a marking device, such as a direct marking printer, or the like.

While particular embodiments have been described, alternatives, modifications, variations and improvements may be implemented within the spirit and scope of the invention.

What is claimed is:

1. A method for measuring an x-interlace error in a marking device having a printhead, the method comprising:

printing a test pattern with the printhead during a plurality of passes, the test pattern containing a plurality of dashes;

sensing the test pattern across the plurality of dashes printed by the printhead using a linear array sensor, wherein sensing the test pattern comprises obtaining a profile of linear array sensor responses to the plurality of dashes;

determining positions of the plurality of dashes printed during each pass of the printhead, wherein determining positions of the plurality of dashes comprises determining a dash center x-position for each dash based on minimum response locations in the linear array sensor response profile, the dash center x-position being a cross process direction location of a center of a dash and wherein determining the dash center x-position comprises using quadratic interpolation to obtain the dash center x-position; and determining an x-interlace error based on the determined dash positions.

2. The method of claim 1, the dashes comprising a plurality of dash rows, each dash row being printed in a different pass of the printhead.

3. The method of claim 1, the dashes being process direction dashes.

4. The method of claim 3, wherein:

sensing the test pattern comprises obtaining a linear array sensor response profile across the process direction dashes; and determining positions of the dashes comprises determining dash center x-positions based on minimum response locations in the linear array sensor response profile, the dash center x-position being cross process direction locations of centers of the dashes.

5. The method of claim 1, wherein determining the x-interlace error comprises using a linear combination of the dash center x-positions.

6. The method of claim 5, wherein using a linear combination of the dash center x-positions comprises:

measuring an x-position difference between a dash pair printed with a same nozzle of the printhead during two passes of the printhead; and averaging the x-position difference between the dash pair.

7. The method of claim 1, wherein the test pattern consists of a single dash row printed during the plurality of passes of the printhead.

8. The method of claim 7, the dashes being process direction dashes, wherein:

sensing the test pattern comprises obtaining a linear array sensor response profile across the process direction dashes; and determining positions of the dashes comprises determining dash center x-positions based on minimum response locations in the linear array sensor response profile, the dash center x-position being cross process direction locations of centers of the dashes.

9. The method of claim 7, wherein determining the x-interlace error comprises:

determining a first spacing between a first pair of adjacent dashes, each of the first pair of adjacent dashes being printed during a first pass and a second pass, respectively, of the printhead;

determining a second spacing between a second pair of adjacent dashes, each of the second pair of adjacent dashes being printed during the first pass and the second pass, respectively, of the printhead;

determining a mean value of the first and second spacings; and identifying a nonuniform spacing based on the mean value.

10. A computer-readable medium having computer-executable instructions for performing the method of claim 1.

11. A system for measuring an x-interlace error in a marking device, comprising:

a printhead capable of printing a test pattern during a plurality of passes, the test pattern containing a plurality of dashes;

a response obtaining circuit, routine or application that senses the test pattern across the plurality of dashes printed by the printhead using a linear array sensor, wherein the response obtaining circuit, routine or application obtains a profile of linear array sensor responses to the plurality of dashes;

a line center determining circuit, routine or application that determines positions of the plurality of dashes printed during each pass of the printhead, wherein the line center determining circuit, routine or application determines a dash center x-position for each dash based on minimum response locations in the linear array sensor response profile, the dash center x-position being a cross process direction location of a center of a dash, and wherein the line center determining circuit, routine or application uses quadratic interpolation to obtain the dash center x-position; and an error determining circuit, routine or application that determines an x-interlace error based on the determined dash positions.

12. The system of claim 11, the dashes comprising a plurality of dash rows, each dash row being printed in a different pass of the printhead.

13. The system of claim 11, the dashes being process direction dashes.

14. The system of claim 13, wherein:

the response obtaining circuit, routine or application obtains a linear array sensor response profile across the process direction dashes; and the line center determining circuit, routine or application determines positions of the dashes comprises determining dash center x-positions based on minimum response locations in the linear array sensor response profile, the dash center x-position being cross process direction locations of centers of the dashes.

15. The system of claim 11, wherein the error determining circuit, routine or application determines the x-interlace error using a linear combination of the dash center x-positions.

16. The system of claim 15, wherein the error determining circuit, routine or application:

measures an x-position difference between a dash pair printed with a same nozzle of the printhead during two passes of the printhead; and averages the x-position difference between the dash pair.

17. The system of claim 11, wherein the test pattern consists of a single dash row printed during the plurality of passes of the printhead.

18. The system of claim 17, the dashes being process direction dashes, wherein:

the response obtaining circuit, routine or application obtains a linear array sensor response profile across the process direction dashes; and the line center determining circuit, routine or application determines dash center x-positions based on minimum response locations in the linear array sensor response profile, the dash center x-position being cross process direction locations of centers of the dashes.

19. The system of claim 17, wherein the error determining circuit, routine or application:

determines a first spacing between a first pair of adjacent dashes, each of the first pair of adjacent dashes being printed during a first pass and a second pass, respectively, of the printhead;

determines a second spacing between a second pair of adjacent dashes, each of the second pair of adjacent dashes being printed during the first pass and the second pass, respectively, of the printhead;

determines a mean value of the first and second spacings; and identifies a nonuniform spacing based on the mean value.

20. A marking device including the system of claim 11.

21. The marking device of claim 20, wherein the marking device is a direct marking printer.

* * * * *